US011047390B2

(12) United States Patent
Kotani

(10) Patent No.: US 11,047,390 B2
(45) Date of Patent: Jun. 29, 2021

(54) OIL FEED TYPE AIR COMPRESSOR

(71) Applicant: Hitachi, Ltd., Tokyo (JP)

(72) Inventor: Masanao Kotani, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 9 days.

(21) Appl. No.: 16/633,793

(22) PCT Filed: Apr. 16, 2018

(86) PCT No.: PCT/JP2018/015736
§ 371 (c)(1),
(2) Date: Jan. 24, 2020

(87) PCT Pub. No.: WO2019/049415
PCT Pub. Date: Mar. 14, 2019

(65) Prior Publication Data

US 2020/0240415 A1 Jul. 30, 2020

(30) Foreign Application Priority Data

Sep. 6, 2017 (JP) ..... JP2017-171559

(51) Int. Cl.
*F04C 29/04* (2006.01)
*F04B 39/06* (2006.01)
(Continued)

(52) U.S. Cl.
CPC ..... *F04C 29/04* (2013.01); *F04B 39/06* (2013.01); *F04B 39/062* (2013.01); *F04B 49/02* (2013.01);
(Continued)

(58) Field of Classification Search
CPC ..... F04C 29/04; F04C 29/042; F04C 29/021; F04C 29/026; F04C 29/0007;
(Continued)

(56) References Cited

U.S. PATENT DOCUMENTS 3,785,755 A * 1/1974 Novak ..... F04C 29/042 418/85
6,058,727 A * 5/2000 Fraser, Jr. ..... F25B 31/002 62/190
(Continued)

FOREIGN PATENT DOCUMENTS

GB 2367334 A * 4/2002 ..... F04C 29/0007
JP 53-76412 A 7/1978
(Continued)

OTHER PUBLICATIONS

International Preliminary Report on Patentability (PCT/IB/338 & PCT/IB/373) issued in PCT Application No. PCT/JP2018/015736 dated Mar. 19, 2020, including English translation of document C2 (Japanese-language Written Opinion (PCT/ISA/237) previously filed on Jan. 24, 2020) (six (6) pages).
(Continued)

*Primary Examiner* — Christopher S Bobish
(74) *Attorney, Agent, or Firm* — Crowell & Moring LLP

(57) ABSTRACT

The present invention provides an oil feed type air compressor that can reduce a power consumption of a compressor body during an unload operation. The oil feed type air compressor includes: a compressor body (1) compressing air while feeding an oil into a compression chamber; a separator (4) disposed on a discharge side of the compressor body; a compressed air-feeding system (5) feeding the compressed air separated by the separator to a use destination of the compressed air; an oil-feeding system (6) feeding the oil separated by the separator to the compression chamber of the compressor body; an oil cooler (11) and a temperature sensor (12) disposed in the oil-feeding system; and a controller enabling execution of a temperature control. The temperature control by the controller is performed by variably controlling a rotation speed of a cooling fan (13) such that, during the load operation, a temperature detected by the temperature sensor is a target value T1, and during the unload operation, the temperature detected by the temperature sensor is a target value T2 (with the proviso of T1>T2).

6 Claims, 9 Drawing Sheets

(51) Int. Cl.
*F04B 49/02* (2006.01)
*F04C 29/02* (2006.01)
*F04C 29/00* (2006.01)

(52) U.S. Cl.
CPC ..... *F04B 49/022* (2013.01); *F04C 29/0007* (2013.01); *F04C 29/0014* (2013.01); *F04C 29/021* (2013.01); *F04C 29/026* (2013.01); *F04C 29/042* (2013.01); *F04C 2270/195* (2013.01)

(58) Field of Classification Search
CPC ..... F04C 29/0014; F04C 2270/195; F04B 39/06; F04B 39/062; F04B 49/02; F04B 49/022
See application file for complete search history.

(56) References Cited

U.S. PATENT DOCUMENTS 9,057,374 B2 * 6/2015 Fujimoto ..... F04C 18/16
2008/0082218 A1 * 4/2008 Fornof ..... F04B 39/06 700/299
2009/0087320 A1 * 4/2009 Tanaka ..... F04C 29/04 417/228
2013/0156548 A1 * 6/2013 Takano ..... F04C 29/04 415/114
2017/0101991 A1 * 4/2017 Yenneti ..... B01D 53/263

FOREIGN PATENT DOCUMENTS

JP 8-4679 A 1/1996
JP 2006-316696 A 11/2006
JP 2008-128052 A 6/2008
JP 2009-85045 A 4/2009
WO WO 02/46617 A1 6/2002

OTHER PUBLICATIONS

International Search Report (PCT/ISA/210) issued in PCT Application No. PCT/JP2018/015736 dated Jul. 17, 2018 with English translation (three (3) pages).
Japanese-language Written Opinion (PCT/ISA/237) issued in PCT Application No. PCT/JP2018/015736 dated Jul. 17, 2018 (three (3) pages).

* cited by examiner

OIL FEED TYPE AIR COMPRESSOR

TECHNICAL FIELD

The present invention relates to an oil feed type air compressor for compressing air while feeding an oil into a compression chamber.

BACKGROUND ART

The oil feed type air compressor includes a compressor body, a separator connected to a discharge side of the compressor body, and a compressed air-feeding system and an oil-feeding system which are connected to the separator. The compressor body compresses air while feeding the oil into the compression chamber for the purpose of removing compression heat, lubricating the rotor, and sealing the compression chamber, or the like. The separator separates the compressed air discharged from the compressor body and the oil contained in the air. The compressed air-feeding system feeds the compressed air separated by the separator to a use destination. The oil-feeding system feeds the oil separated by the separator to the compression chamber by a pressure difference between the separator and the compression chamber in the compressor body. The oil-feeding system has an oil cooler for cooling the oil.

As the prior art for the aforementioned oil feed type air compressor, there have been known a compressor including: a cooling fan for feeding cooling air to an oil cooler; a temperature sensor that is disposed between a compressor body and a separator and detects a discharge temperature of the compressor body (specifically, that is a temperature of a compressed air, but also regarded as a temperature of an oil contained in the compressed air); and a controller for variably controlling a rotation speed of the cooling fan depending on the temperature detected by the temperature sensor (see e.g. Patent Document 1).

The controller in the prior art variably controls the rotation speed of the cooling fan to adjust the temperature of the oil to be fed to a compression chamber of the compressor body such that the temperature detected by the temperature sensor is a predetermined target value (specifically, a value higher than a dew-point temperature). Thereby, it prevents the compressed air from being supercooled and generating a condensed water.

Another oil feed type air compressor is known, which includes: a suction throttle valve disposed on a suction side of a compressor body; an air relief system connected to a separator; an air relief valve disposed in the air relief system; a pressure sensor disposed in a compressed air-feeding system; and a controller for switching between a load operation and an unload operation for the compressor body depending on a pressure detected by the pressure sensor (in other words, a pressure of the compressed air, fluctuating depending on a balance between a feed rate and a usage rate of the compressed air).

If the pressure detected by the pressure sensor rises to a predetermined upper limit value during the load operation of the compressor body, the controller in the prior art switches the air relief valve from a closed state to an open state, and switches the suction throttle valve from an open state to a closed state. Thereby, the compressor body is switched from the load operation to the unload operation. Furthermore, if the pressure detected by the pressure sensor falls to a predetermined lower limit value during the unload operation of the compressor body, the controller switches the air relief valve from the open state to the closed state, and switches the suction throttle valve from the closed state to the open state. Thereby, the compressor body is switched from the unload operation to the load operation.

PRIOR ART DOCUMENT

Patent Document

Patent Document 1: JP-2009-85045-A

SUMMARY OF THE INVENTION

Problem to be Solved by the Invention

In the aforementioned prior art, a target value of a discharge temperature of the compressor body is fixed so as to be higher than a dew-point temperature corresponding to a discharge pressure of the compressor body. However, the discharge pressure fluctuates by switching between the load operation and the unload operation for the compressor body. During the unload operation of the compressor body, the discharge pressure is lower than that during the load operation, and therefore the corresponding dew-point temperature also decreases. For this reason, during the unload operation of the compressor body, there is a room to decrease the target value of the discharge temperature, i.e. a room to decrease the temperature of the oil to be fed to a compression chamber of the compressor body, compared to during the load operation. The compressed air can be efficiently cooled by decreasing the temperature of the oil to be fed to the compression chamber of the compressor body. Consequently, a power consumption of the compressor body can be reduced.

The present invention has been made in view of the above circumstances, and an object of the present invention is to reduce a power consumption of a compressor body during an unload operation.

Means for Solving the Problem

In order to solve the above problems, the configurations described in claims are applied. The present invention includes a plurality of means solving the above problems, and an example of the means include: a compressor body compressing air while feeding an oil into a compression chamber; a separator separating a compressed air discharged from the compressor body and an oil contained in the compressed air; a compressed air-feeding system feeding the compressed air separated by the separator to a use destination of the compressed air; an oil-feeding system feeding the oil separated by the separator to the compression chamber of the compressor body; an oil cooler and a temperature sensor disposed in the oil-feeding system; and a controller enabling execution of a temperature control for variably controlling a cooling power of the oil cooler such that an oil temperature detected by the temperature sensor is a target value. In the temperature control by the controller, during a load operation, the cooling power of the oil cooler is variably controlled such that the oil temperature detected by the temperature sensor is a first target value, and during an unload operation, the cooling power of the oil cooler is variably controlled such that the oil temperature detected by the temperature sensor is a second target value lower than the first target value.

Advantages of the Invention

The present invention makes it possible to reduce a power consumption of a compressor body during an unload operation.

Problems, configurations, and effects other than those described above will be clarified by the following description.

MODES FOR CARRYING OUT THE INVENTION

Figure 2:
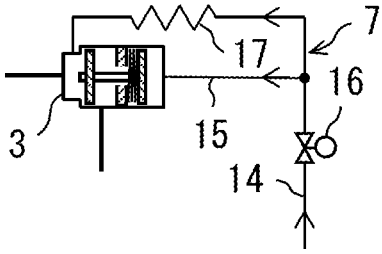
FIG. 2 is a diagram illustrating an open state of the air relief valve and a closed state of the suction throttle valve as an unload operation state in the first embodiment of the present invention.
Figure 3:
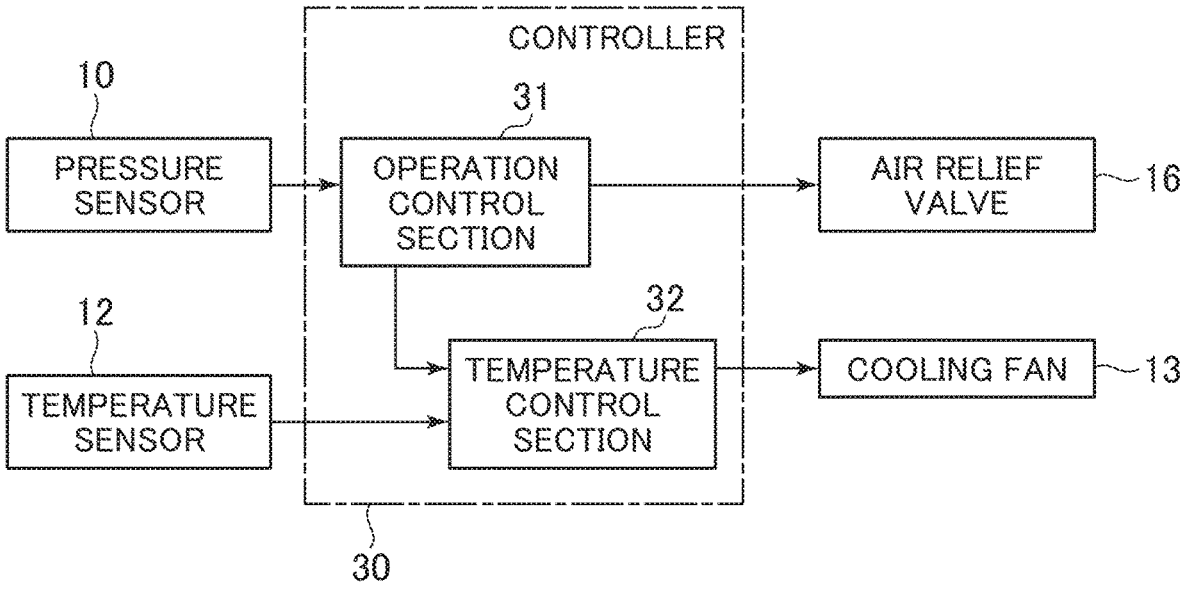
FIG. 3 is a block diagram illustrating a functional configuration of a controller in the first embodiment of the present invention.

A first embodiment of the present invention will be explained with reference to FIG. 1 to FIG. 3.

Figure 1:
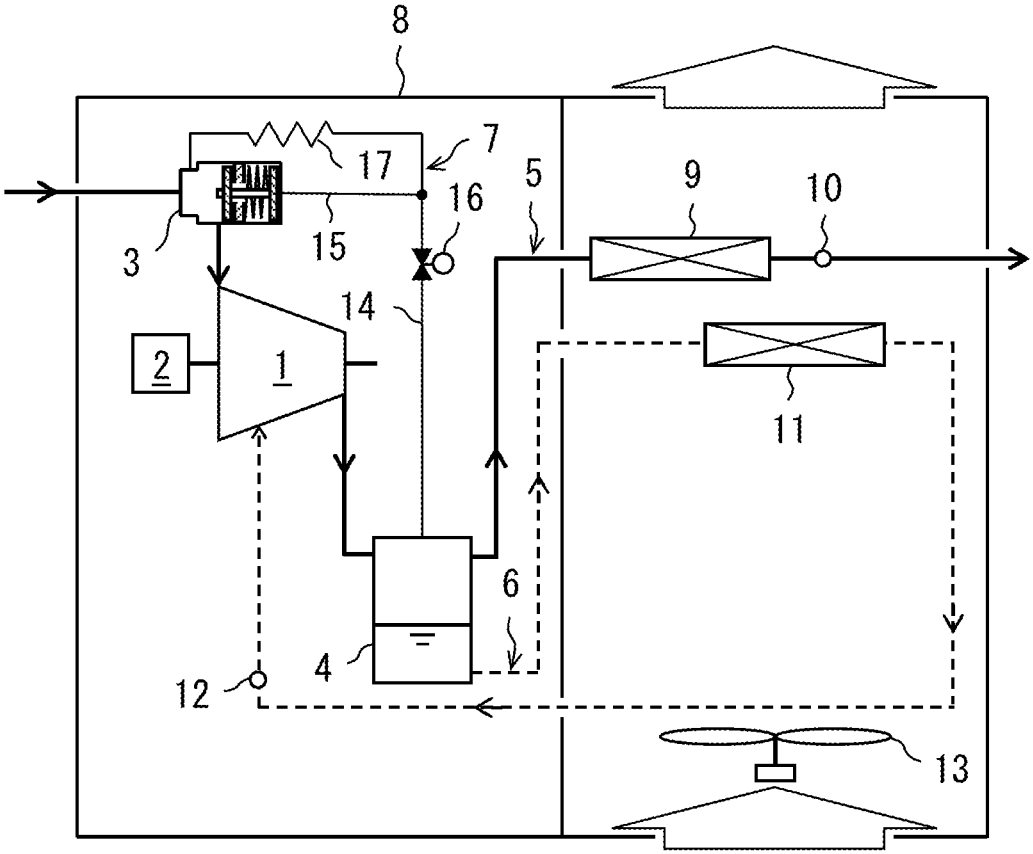
FIG. 1 is a schematic diagram illustrating a configuration of an oil feed type air compressor, which presents a closed state of an air relief valve and an open state of a suction throttle valve as a load operation state in a first embodiment of the present invention.

FIG. 1 is a schematic diagram illustrating a configuration of an oil feed type air compressor in the first embodiment, which presents a closed state of an air relief valve and an open state of a suction throttle valve as a load operation state. FIG. 2 is a diagram illustrating an open state of the air relief valve and a closed state of the suction throttle valve as an unload operation state in the first embodiment. FIG. 3 is a block diagram illustrating a functional configuration of a controller in the first embodiment.

The oil feed type air compressor according to the first embodiment includes: a compressor body 1; an electric motor 2 for driving the compressor body 1; a suction throttle valve 3 disposed on a suction side of the compressor body 1; a separator 4 connected to a discharge side of the compressor body 1; a compressed air-feeding system 5, an oil-feeding system 6, and an air relief system 7 which are connected to the separator 4; and a controller 30. Incidentally, the compressor body 1, the electric motor 2, the suction throttle valve 3, the separator 4, the compressed air-feeding system 5, the oil-feeding system 6, the air relief system 7, the controller 30, and the like are mounted in a package type compressor unit 8.

Although not illustrated in detail, the compressor body 1 has a pair of male and female screw rotors that mesh with each other, and a casing for housing the screw rotors, and a plurality of compression chambers are formed in tooth grooves of the screw rotors. Once the screw rotors rotate, the compression chambers move in an axial direction of the rotors (from the left side toward the right side in FIG. 1). The compression chambers suck air and compress the air, and discharge the compressed air. The compressor body 1 is configured to feed oil into the compression chambers, e.g. immediately after the start of compression, for the purpose of removing a compression heat, lubricating the rotors, sealing the compression chambers, or the like.

The separator 4 separates the compressed air discharged from the compressor body 1 from the oil contained in the air, and stores the separated oil in a lower part of the separator. The compressed air separated by the separator 4 is fed to a use destination outside of the unit through the compressed air-feeding system 5. The compressed air-feeding system 5 includes a pressure regulating valve (check valve) not illustrated in the figures, an air-cooled type aftercooler 9 disposed downstream of the pressure regulating valve, and a pressure sensor 10 disposed downstream of the pressure regulating valve (downstream of the aftercooler 9 in the first embodiment).

The oil stored in the separator 4 is fed to the compression chambers through the oil-feeding system 6 by a pressure difference between the separator 4 and the compression chambers of the compressor body 1. The oil-feeding system 6 includes an air-cooled type oil cooler 11, and a temperature sensor 12 disposed downstream of the oil cooler 11. The oil cooler 11 cools the oil with a cooling air fed from a cooling fan 13. Incidentally, the oil-feeding system 6 may feed the oil not only to the compression chambers of the compressor body 1 but also to a bearing, or the like.

The air relief system 7 includes: an air relief pathway 14 connected between the separator 4 and a primary side of the suction throttle valve 3 (specifically upstream of the valve seat); an operation pathway 15 branched from a branch of the air relief pathway 14 and connected to an operation chamber of the suction throttle valve 3; an air relief valve 16 (solenoid valve) disposed on a separator 4 side relative to the branch of the air relief pathway 14; a fixed throttle 17 disposed on the primary side of the suction throttle valve 3 relative to the branch of the air relief pathway 14 (i.e. a resistor for reducing an air relief speed).

When the air relief valve 16 is closed as illustrated in FIG. 1, the air relief system 7 does not relieve air from the separator 4 to the primary side of the suction throttle valve 3. At this time, the suction throttle valve 3 is opened because a pressure in the operation chamber falls. Thereby, the compressor body 1 is under the load operation. On the other hand, when the air relief valve 16 is opened as illustrated in FIG. 2, the air relief system 7 relieves air from the separator 4 to the primary side of the suction throttle valve 3. At this time, the suction throttle valve 3 is closed because the pressure in the operation chamber rises. Thereby, the compressor body 1 is under the unload operation.

The controller 30 includes: an arithmetic control section (e.g. CPU) for executing arithmetic processing and control processing based on a program; a memory section (e.g. ROM and RAM) for storing programs and arithmetic processing results; and the like. The functional configuration of the controller 30 includes: an operation control section 31 for switching the compressor body 1 from an unload operation to a load operation depending on a compressed air pressure detected by the pressure sensor 10 (in other words, a compressed air pressure fluctuating depending on a balance between a feed rate and a usage rate of the compressed air); and a temperature control section 32 for variably controlling a rotation speed of the cooling fan 13 (i.e. cooling power of the oil cooler 11) such that a temperature of the oil detected by the temperature sensor 12 is a target value (hereinafter, will be explained in detail).

The operation control section 31 judges whether or not the pressure detected by the pressure sensor 10 has risen to a predetermined upper limit value during the load operation of the compressor body 1. If the pressure detected by the pressure sensor 10 has risen to the upper limit value, the operation control section switches the air relief valve 16 from the closed state to the open state. Thereby, the suction throttle valve 3 is switched from the open state to the closed state. Thus, the compressor body 1 is switched from the load operation to the unload operation. In addition, the operation control section 31 judges whether or not the pressure detected by the pressure sensor 10 has fallen to a predetermined lower limit value during the unload operation of the compressor body 1. If the pressure detected by the pressure sensor 10 has fallen to the lower limit value, the operation control section switches the air relief valve 16 from the open state to the closed state. Thereby, the suction throttle valve 3 is switched from the closed state to the open state. Consequently, the compressor body 1 is switched from the unload operation to the load operation.

A target value of an oil temperature in the control by the temperature control section 32 should be set so as to be lower than an air temperature in the compression chambers to which the oil is fed, and higher than a dew-point temperature corresponding to a discharge pressure of the compressor body 1. Herein, by switching between the load operation and the unload operation as described above, the discharge pressure of the compressor body 1 fluctuates. Since the discharge pressure of the compressor body 1 decreases during the unload operation compared to during the load operation, the corresponding dew-point temperature also decreases (see FIG. 8 described later). For this reason, there is a room to decrease the target value of the oil temperature of the compressor body 1 during the unload operation compared to during the load operation.

Thus, during the load operation, the temperature control section 32 of the controller 30 variably controls the rotation speed of the cooling fan 13 such that the oil temperature detected by the temperature sensor 12 is a predetermined target value T1, and during the unload operation, variably controls the rotation speed of the cooling fan 13 such that the oil temperature detected by the temperature sensor 12 is a predetermined target value T2 (with the proviso of T1>T2). Thereby, the compressed air can be efficiently cooled by decreasing the temperature of the oil to be fed to the compression chambers in the compressor body 1 during the unload operation. Consequently, a power consumption of the compressor body 1 during the unload operation can be reduced.

In the first embodiment, although the case that the target values T1 and T2 of the oil temperature are the predetermined values (fixed values) has been explained as an example, the present invention is not limited to the case, and modifications can be made without departing from the gist and the technical idea of the present invention. That means, for example, a pressure sensor is disposed between the compressor body 1 and the separator 4 (or inside of the separator 4), and the temperature control section 32 of the controller 30 calculates a dew-point temperature based on a discharge pressure of the compressor body 1 detected by the pressure sensor, and a target value of the oil temperature may be calculated by adding a predetermined clearance to the dew-point temperature. Furthermore, for example, a temperature sensor for detecting a suction air temperature (i.e. ambient air temperature) of the compressor body 1 is installed, and the aforementioned dew-point temperature may be calculated by using not only the discharge pressure of the compressor body 1 but also the suction air temperature of the compressor body detected by the temperature sensor. Also in such a modified example, the target value of the oil temperature during the unload operation is lower than the target value of the oil temperature during the load operation, and therefore the same effect as described above can be obtained.

A second embodiment of the present invention will be explained with reference to FIG. 4 and FIG. 5.

Figure 4:
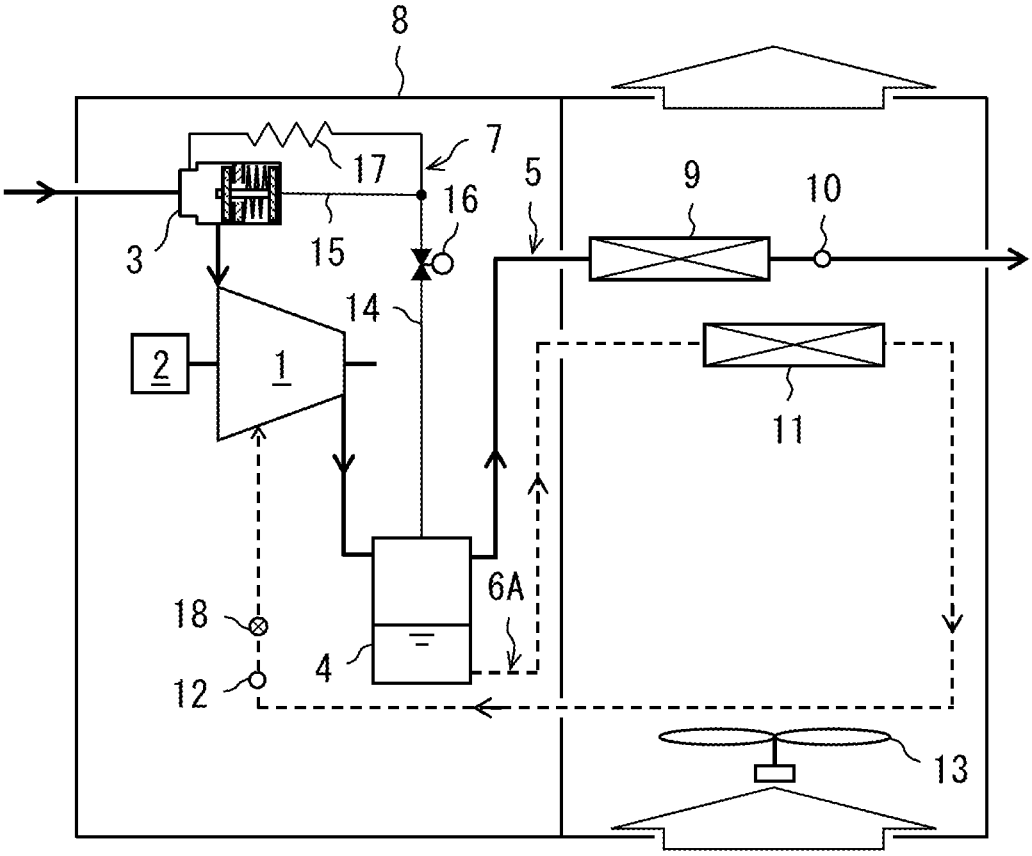
FIG. 4 is a schematic diagram illustrating a configuration of an oil feed type air compressor in a second embodiment of the present invention, which presents a load operation state.

FIG. 4 is a schematic diagram illustrating a configuration of an oil feed type air compressor in the second embodiment, which presents a load operation state. FIG. 5 is a block diagram illustrating a functional configuration of a controller in the second embodiment. In the second embodiment, for the same parts as those in the first embodiment and its modified example, the same reference characters as those in the first embodiment and its modified example are provided, and explanations of the parts are arbitrarily omitted.

Once the compressor body 1 is switched from the load operation to an unload operation, a pressure of the separator 4 decreases, but more than that pressures of the compression chambers of the compressor body 1 rapidly decrease. For that reason, a flow rate of the oil to be fed to the compression chambers of the compressor body 1 becomes excessive unless certain measures are taken. If the oil flow rate becomes excessive, a power consumption of the compressor body 1 instead increases.

Thus, in the second embodiment, an oil-feeding system 6A includes: besides the oil cooler 11 and the temperature sensor 12; a flow control valve 18 (solenoid valve) disposed downstream of the oil cooler 11. A controller 30A includes: besides the operation control section 31 and the temperature control section 32; a flow control section 33 for variably controlling an opening degree of the flow control valve 18 to control the flow rate of the oil to be fed to the compression chambers of the compressor body 1. During the unload operation, the flow control section 33 controls the opening degree of the flow control valve 18 such that the opening degree is smaller than during the load operation. This prevents the flow rate of the oil to be fed to the compression chambers of the compressor body 1 from becoming excessive. Consequently, the power consumption of the compressor body 1 during the unload operation can be further reduced compared to the first embodiment.

A third embodiment of the present invention will be explained with reference to FIG. 6 to FIG. 8.

Figure 6:
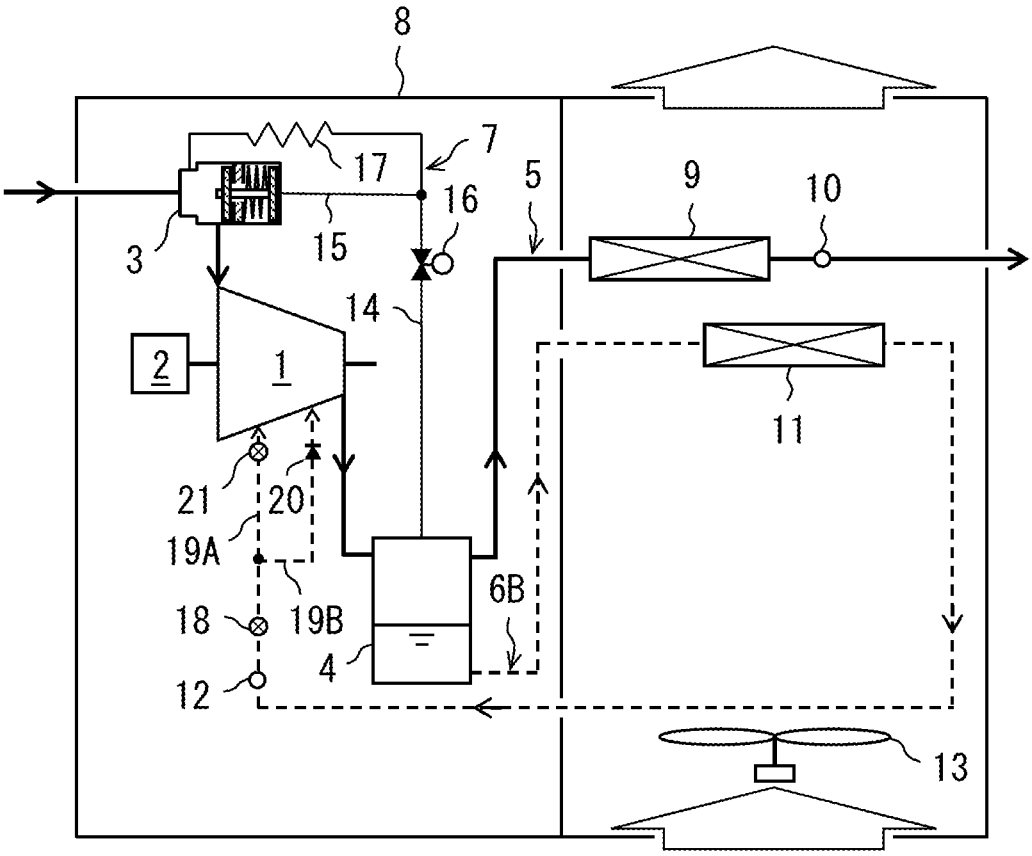
FIG. 6 is a schematic diagram illustrating a configuration of an oil feed type air compressor in a third embodiment of the present invention, which presents a load operation state.

FIG. 6 is a schematic diagram illustrating a configuration of an oil feed type air compressor in the third embodiment, which presents a load operation state. FIG. 7 is a block diagram illustrating a functional configuration of a controller in the third embodiment. FIG. 8 is a diagram illustrating changes in a pressure and a temperature of air, and a dew-point temperature corresponding to the air pressure in a compressor body during a compression process, in the third embodiment. In the third embodiment, for the same parts as those in the first and second embodiments and their modified examples, the same reference characters as those in the first and second embodiments and their modified examples are provided, and explanations of the parts are arbitrarily omitted.

In the third embodiment, an oil-feeding system 6B includes: besides the oil cooler 11, the temperature sensor 12, and the flow control valve 18; two-stage oil feed pathways 19A and 19B for feeding oil to each of two compression chambers having different progresses of compression process; a check valve 20 disposed on the second-stage oil feed pathway 19B as the final stage (in other words, a pathway which feeds the oil to a compression chamber located closest to the discharge side among the compression chambers to which the oil feed pathways 19A and 19B feed the oil); and a throttle valve 21 disposed on the first-stage oil feed pathway 19A as the stage other than the final stage.

A controller 30B includes: besides the operation control section 31, the temperature control section 32, and the flow control section 33; a distribution ratio control section 34 for variably controlling an opening degree of the throttle valve 21 depending on the switching between the load operation and the unload operation of the compressor body 1 such that a distribution ratio of each oil to be fed from the two-stage oil feed pathways 19A and 19B to the two compression chambers is constant (specifically, e.g. equal ratio). More specifically, a total flow of the oil in the oil-feeding system 6B fluctuates depending on the switching between the load operation and the unload operation of the compressor body 1, and on change in the opening degree of the flow control valve 18 accompanying this switching. Thereby, even if the total flow of the oil in the oil-feeding system 6B fluctuates, the distribution ratio control section 34 variably controls the opening degree of the throttle valve 21 such that the distribution ratio of each oil to be fed from the two-stage oil feed pathways 19A and 19B to the two compression chambers is constant.

Figure 8:
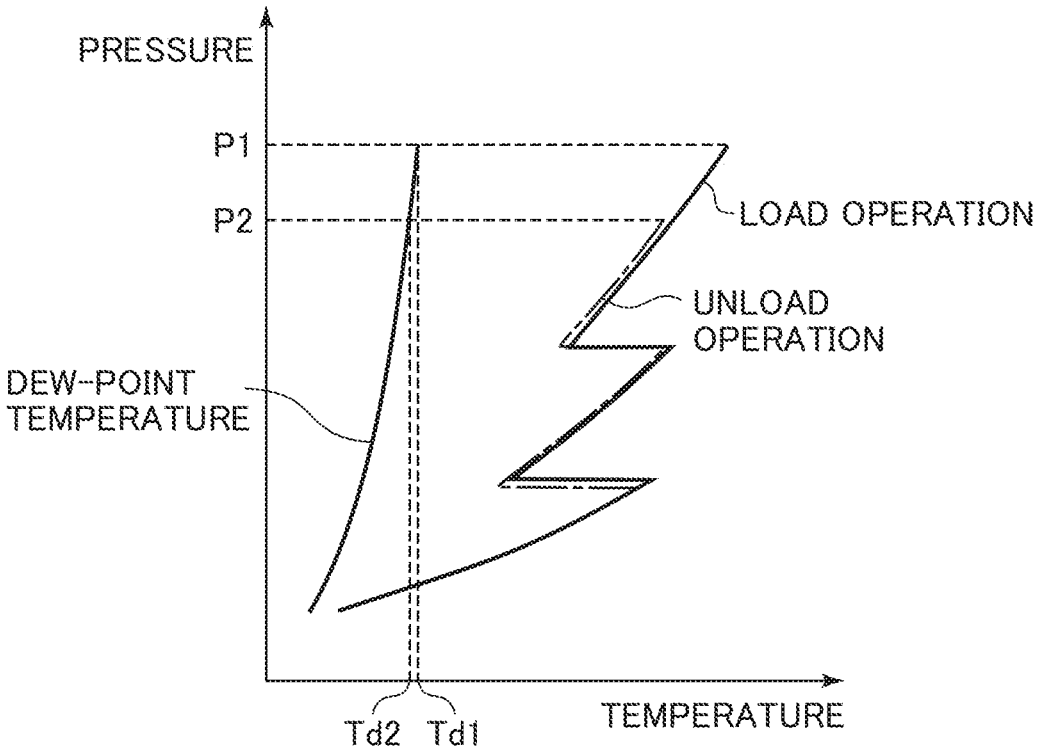
FIG. 8 is a diagram illustrating changes in a temperature and a pressure of air, and a dew-point temperature corresponding to the air pressure in a compressor body during a compression process, in the third embodiment of the present invention.

In the third embodiment configured as described above, the compressed air can be efficiently cooled by feeding the oil through the two-stage oil feed pathways 19A and 19B compared to the case of feeding the oil through the first-stage oil feed pathway (see FIG. 8). Consequently, the power consumption of the compressor body 1 during the load operation and the unload operation can be reduced.

In addition, the check valve 20 is disposed on the oil feed pathway 19B at the final stage, so that reflux from a compression chamber at a higher pressure side to the oil feed pathway 19B can be prevented. Furthermore, reflux from the compression chamber at the higher pressure side to the compression chamber at the lower pressure side through the oil feed pathways 19A and 19B, and overcooling of the compressed air caused by the reflux can be prevented.

In the third embodiment, the same features and effects as those in the first embodiment can be obtained, and the features and effects will be supplementarily explained with reference to FIG. 8. Since a discharge pressure P2 of the compressor body 1 during the unload operation decreases relative to a discharge pressure P1 of the compressor body 1 during the load operation, a dew-point temperature Td2 corresponding to the discharge pressure P2 also decreases relative to a dew-point temperature Td1 corresponding to the discharge pressure P1. Thus, during the unload operation of the compressor body 1, there is a room to decrease a target value of the oil temperature compared to during the load operation.

During the load operation, the temperature control section 32 of the controller 30B variably controls the rotation speed of the cooling fan 13 such that the oil temperature detected by the temperature sensor 12 is the predetermined target value T1 (with the proviso of T1>Td1). On the other hand, during the unload operation, the temperature control section 32 variably controls the rotation speed of the cooling fan 13 such that the oil temperature detected by the temperature sensor 12 is the predetermined target value T2 (with the proviso of T1>T2>Td2). Thereby, the compressed air can be efficiently cooled by decreasing the temperature of the oil to be fed to the compression chambers in the compressor body 1 during the unload operation.

Figure 5:
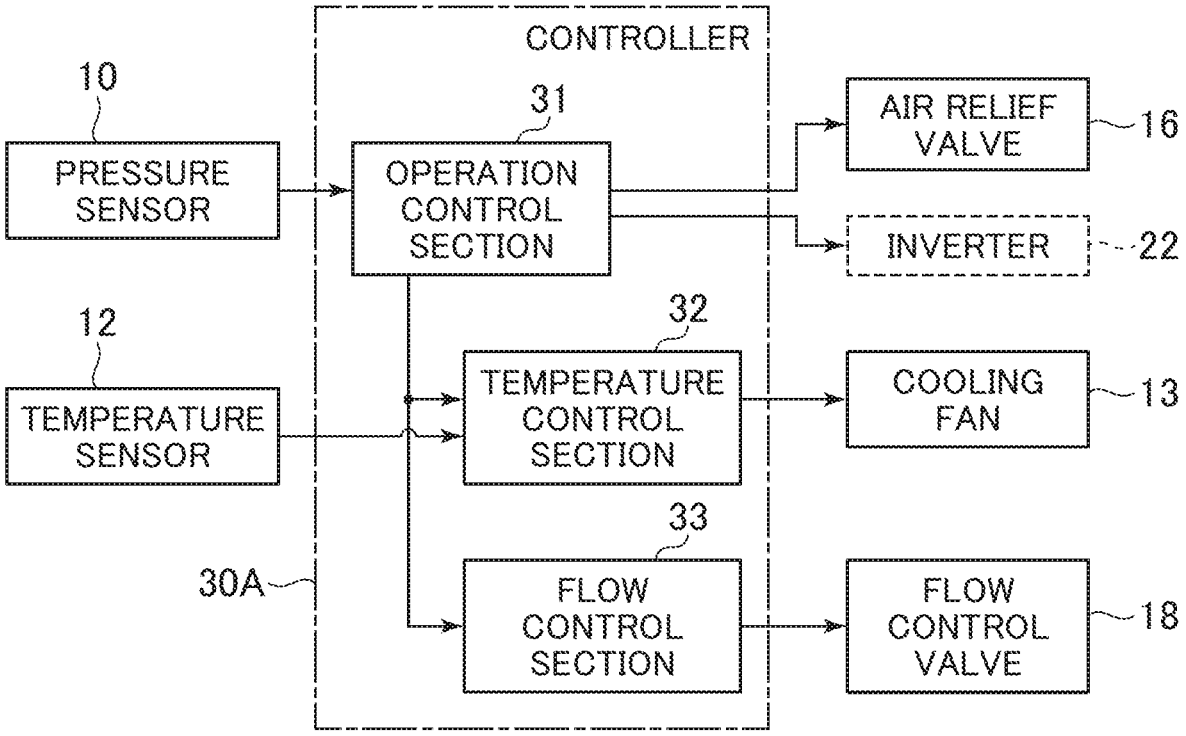
FIG. 5 is a block diagram illustrating a functional configuration of a controller in the second embodiment of the present invention.
Figure 7:
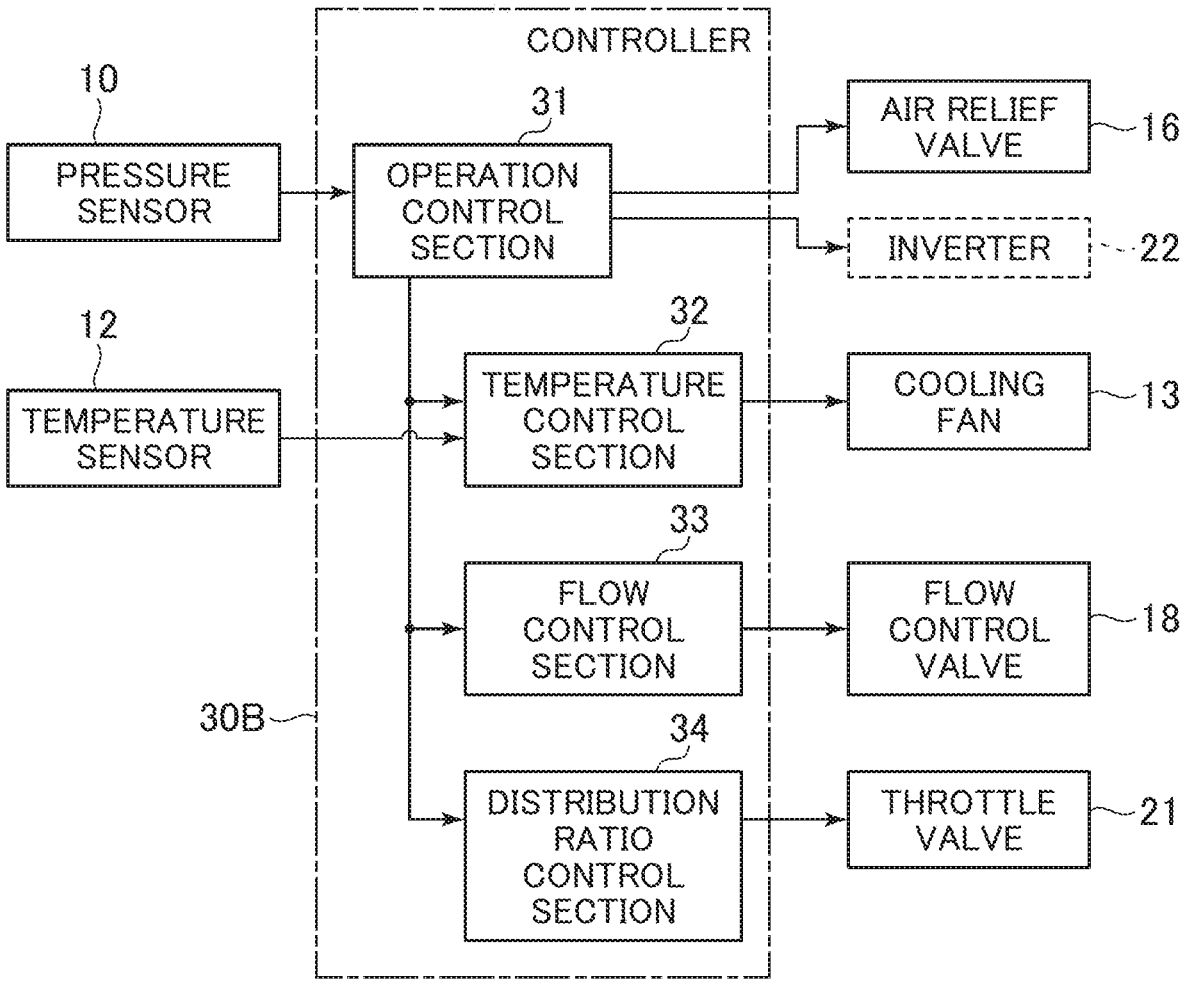
FIG. 7 is a block diagram illustrating a functional configuration of a controller in the third embodiment of the present invention.

Although not particularly explained in the second and third embodiments and their modified examples, the oil feed type air compressor may include an inverter 22 for variably controlling the rotation speed of the electric motor 2 as indicated by the dotted lines in FIG. 5 and FIG. 7. During the load operation, the operation control section 31 of the controller 30A or 30B variably controls a rotation speed of the electric motor 2 within e.g. a range of 100% to 30% via the inverter 22 such that the pressure of the compressed air detected by the pressure sensor 10 is a predetermined target value (specifically, a value predetermined within the range of the upper limit value to the lower limit value described above). Then, when the rotation speed of the electric motor 2 decreases to a lower limit value (30%) of a variable control range and the pressure detected by the pressure sensor 10 increases to the upper limit value, the operation is switched to the unload operation. Subsequently, during the unload operation, the rotation speed of the electric motor 2 is fixed to the lower limit value via the inverter 22.

In addition, during the load operation, the flow control section 33 of the controller 30A or 30B variably controls the opening degree of the flow control valve 18 depending on the rotation speed of the electric motor 2 acquired from the operation control section 31 or the inverter 22. More specifically, a compression heat of the compressor body 1 is proportional to a rotation speed of the compressor body 1 (i.e. the rotation speed of the electric motor 2). Thus, when the rotation speed of the electric motor 2 increases, the flow control section 33 increases the opening degree of the flow control valve 18 to increases the flow rate of the oil, and when the rotation speed of the electric motor 2 decreases, the flow control section 33 decreases the opening degree of the flow control valve 18 to decrease the flow rate of the oil. Then, during the unload operation, the flow control section 33 controls the opening degree of the flow control valve 18 so as to be smaller than a minimum value of the opening degree during the load operation. Thereby, the same effect as in the second embodiment can be obtained.

Furthermore, during the load operation, the distribution ratio control section 34 of the controller 30B variably controls the opening degree of the throttle valve 21 depending on the change in the opening degree of the flow control valve 18 acquired from the flow control section 33 (i.e. the change in the total flow of the oil in the oil-feeding system 6B) such that the distribution ratio of each oil to be fed from the two-stage oil feed pathways 19A and 19B to the two compression chambers is constant. Thereby, the same effect as in the third embodiment can be obtained.

In addition, for the second and third embodiments and their modified examples, the flow control section 33 of the controller 30A or 30B has been explained by taking a case that the opening degree of the flow control valve 18 is fixed during the unload operation as an example. However, the present invention is not limited to this case, and modifications can be made without departing from the gist and the technical idea of the present invention. That means, for example, a pressure sensor is disposed inside of the separator (or between the compressor body 1 and the separator 4), and the flow control section 33 of the controller 30A or 30B may variably controls the opening degree of the flow control valve 18 depending on a pressure of the separator 4 detected by the pressure sensor. Specifically, when the pressure of the separator 4 is high, the flow control section 33 decreases the opening degree of the flow control valve 18, and when the pressure of the separator 4 is low, the flow control section 33 increases the opening degree of the flow control valve 18. Also in this case, the same effect as in the second embodiment can be obtained by decreasing a maximum value of the opening degree during the unload operation compared to the opening degree during the load operation.

Furthermore, during the unload operation, the distribution ratio control section 34 of the controller 30B variably controls the opening degree of the throttle valve 21 depending on change in the opening degree of the flow control valve 18 acquired from the flow control section 33 (i.e. change in the total flow of the oil in the oil-feeding system 6B) such that the distribution ratio of each oil to be fed from the two-stage oil feed pathways 19A and 19B to the two compression chambers is constant. Thereby, the same effect as in the third embodiment can be obtained.

Furthermore, although not particularly explained in the third embodiment and its modified example, each of the two-stage oil feed pathways 19A and 19B has an inlet opening toward the compression chamber. In addition, a configuration that a sectional area of the inlet of the second-stage oil feed pathway 19B is smaller than a sectional area of the inlet of the first-stage oil feed pathway 19A may be taken. In such a modified example, oil droplets fed from the second-stage oil feed pathway 19B to the compression chamber at the higher pressure side can be smaller than oil droplets fed from the first-stage oil feed pathway 19A to the compression chamber at the lower pressure side, resulting in an increased cooling efficiency. As a result, even with oil which has been fed into the compression chamber at the higher pressure side and stays in the compressor body 1 for a short time, the compressed air can be sufficiently cooled, and the power consumption of the compressor body 1 can be reduced.

In the third embodiment and its modified example, although the case that the oil-feeding system 6B includes the two-stages oil feed pathways 19A and 19B has been explained as an example, the present invention is not limited to this case, and modifications can be made without departing from the gist and the technical idea of the present invention. That means, the oil-feeding system may include: three or more-stage oil feed pathways; a check valve disposed on a final-stage oil feed pathway among the three or more-stage oil feed pathways; throttle valves disposed on each of the other-stage oil feed pathways other than the final-stage oil feed pathway among the three or more-stage oil feed pathways. Furthermore, each oil feed pathway may be configured such that a sectional area of an inlet of a poststage-side oil feed pathway (i.e. oil feed pathway for feeding the oil to a compression chamber at a discharge side) is smaller than a sectional area of an inlet of a prestage-side oil feed pathway (i.e. oil feed pathway for feeding the oil to a compression chamber at a suction side).

In the first to third embodiments and their modified examples, although the case that the oil-feeding system includes one oil cooler 11 has been explained as an example, the present invention is not limited to this case, and a plurality of oil coolers may be installed. Furthermore, a connection switching circuit for switching between a parallel connection and a series connection for the plurality of oil coolers may be installed. Such a modified example will be explained with reference to FIG. 9 to FIG. 11.

Figure 9:
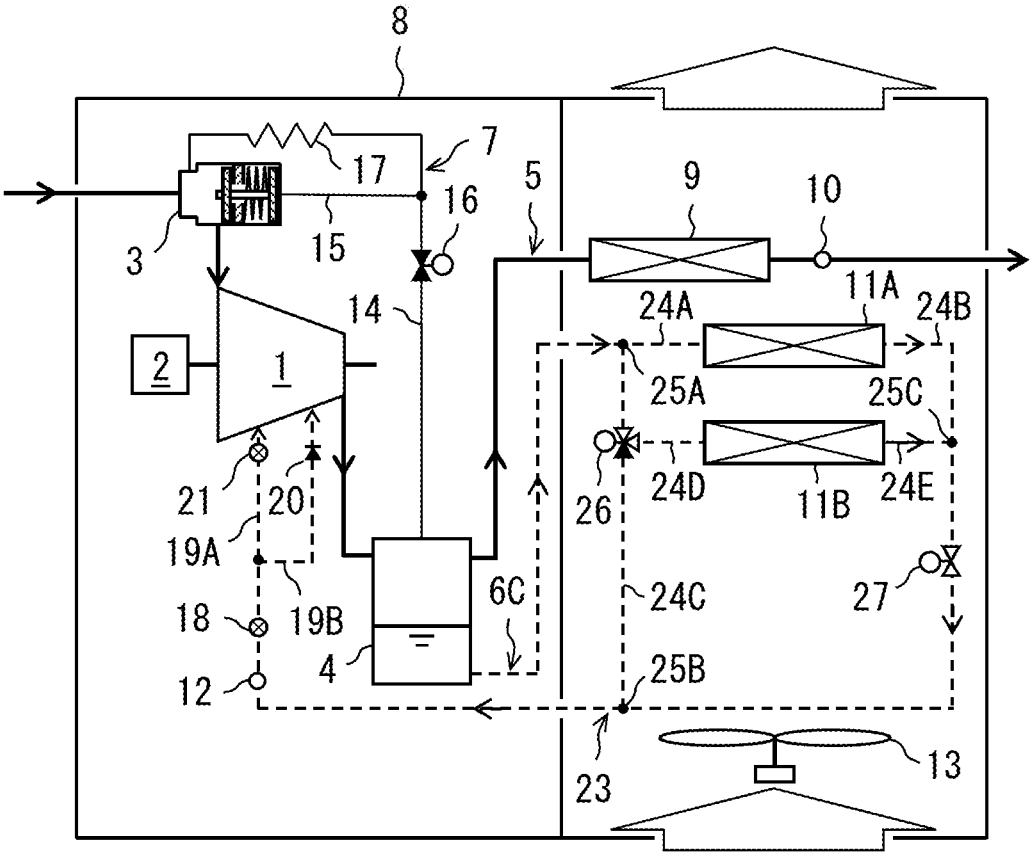
FIG. 9 is a schematic diagram illustrating a configuration of an oil feed type air compressor in a modified example of the present invention, which presents a parallel connection state of an oil cooler during a load operation.
Figure 10:
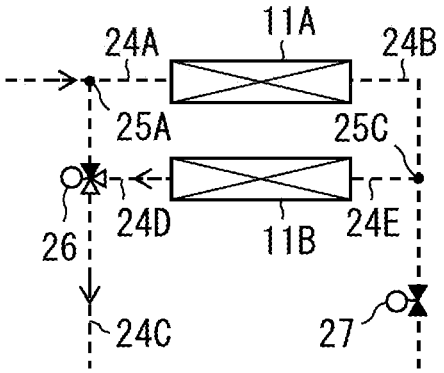
FIG. 10 is a diagram illustrating a series connection state of the oil cooler during an unload operation in the modified example of the present invention.
Figure 11:
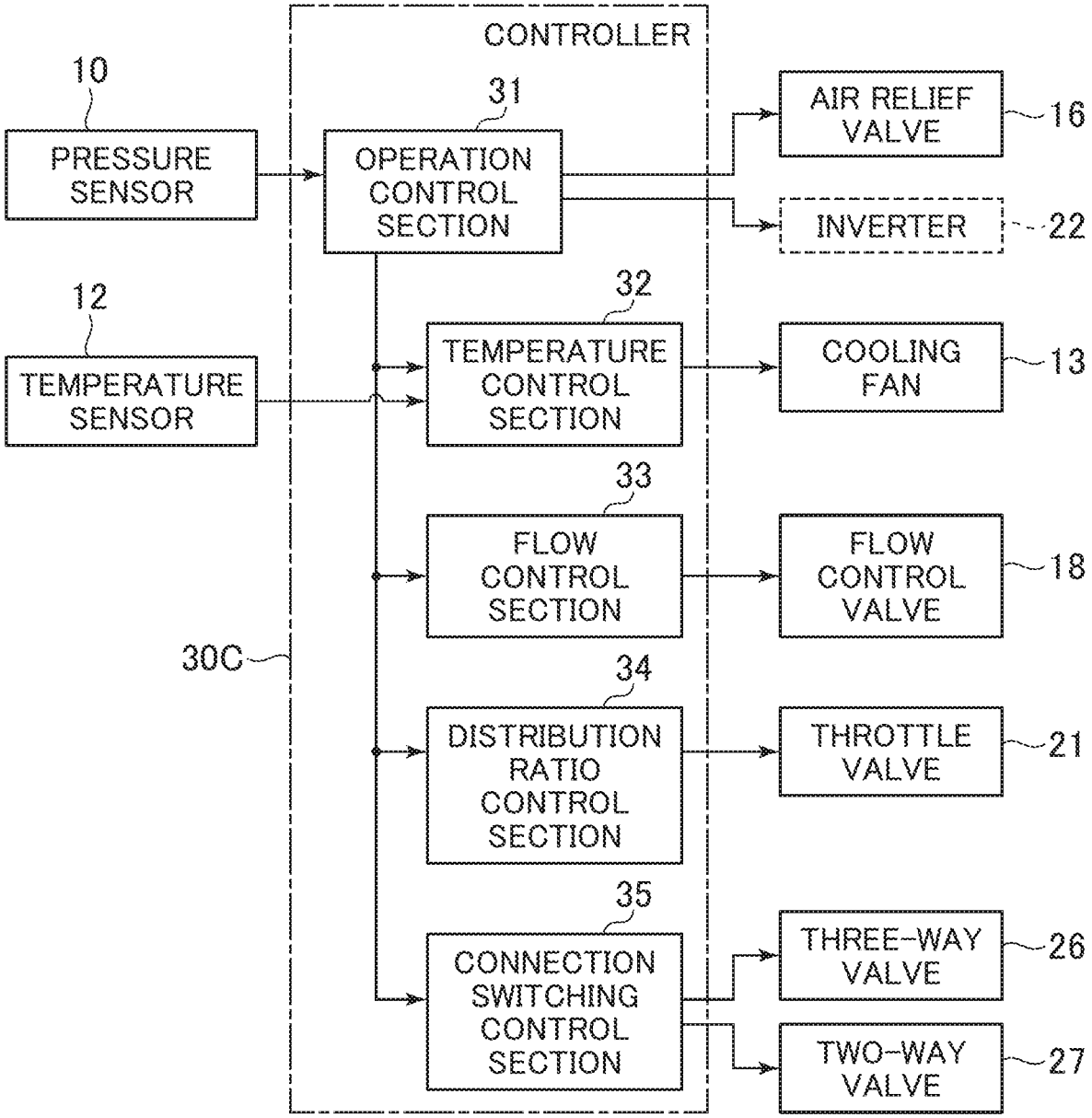
FIG. 11 is a block diagram illustrating a functional configuration of a controller in the modified example of the present invention.

FIG. 9 is a schematic diagram illustrating a configuration of an oil feed type air compressor in the modified example, which presents a parallel connection state of an oil cooler during a load operation. FIG. 10 is a diagram illustrating a series connection state of the oil cooler during an unload operation in the modified example. FIG. 11 is a block diagram illustrating a functional configuration of a controller in the modified example. Note that, in the modified example, for the same parts as those in the first to third embodiments and their modified examples, the same reference characters as those in the first to third embodiments and their modified examples are provided, and explanations of the parts are arbitrarily omitted.

In the modified example, an oil-feeding system 6C includes two oil coolers 11A and 11B, and a connection switching circuit 23 for switching between a parallel connection and a series connection for these oil coolers 11A and 11B.

For example, the connection switching circuit 23 is composed of: a conduit 24A connected between the separator 4 and one side of the oil cooler 11A; a conduit 24B connected between the other side of the oil cooler 11A and the compressor body 1; a conduit 24C connected between a branch 25A of the conduit 24A and a branch 25B of the conduit 24B; a three-way valve 26 (solenoid valve) provided as a branch of the conduit 24C; a conduit 24D connected between the three-way valve 26 and one side of the oil cooler 11B; a conduit 24E connected between a branch 25C located on the oil cooler 11A side relative to the branch 25B of the conduit 24B and the other side of the oil cooler 11B; and a two-way valve 27 (solenoid valve) disposed between the branch 25B and the branch 25C of the conduit 24B.

The three-way valve 26 selects one side from the separator 4 side and the compressor body 1 side to communicate the selected one side with one side of the oil cooler 11B. The two-way valve 27 communicates or interrupts between the branch 25B and the branch 25C of the conduit 24B.

A controller 30C includes a connection switching control section 35 for controlling the three-way valve 26 and the two-way valve 27 of the connection switching circuit 23 to switch between the parallel connection and the series connection for the oil coolers 11A and 11B. During the load operation, the connection switching control section 35 controls the three-way valve 26 to communicate between the separator 4 side and one side of the oil cooler 11B, and controls the two-way valve 27 to communicate between the branches. Thereby, a part of the oil fed from the separator 4 flows into one side of the oil cooler 11A, and the remaining oil flows into one side of the oil cooler 11B. Then, the oil flowing out from the other side of the oil cooler 11A and the oil flowing out from the other side of the oil cooler 11B merge with each other, which are fed to the compression chambers of the compressor body 1.

During the unload operation, the connection switching control section 35 controls the three-way valve 26 to communicate between the compressor body 1 side and one side of the oil cooler 11B, and controls the two-way valve 27 to interrupt the branches. Thereby, whole of the oil fed from the separator 4 flows into one side of the oil cooler 11A, and the oil flowing out from the other side of the oil cooler 11A flows into the other side of the oil cooler 11B. Then the oil flowing out from one side of the oil cooler 11B is fed to the compression chambers of the compressor body 1.

As described above, in the modified example, during the load operation, by connecting the oil coolers 11A and 11B in parallel, a pressure loss of the whole oil coolers can be decreased and an oil flow rate in the oil-feeding system can be increased. On the other hand, during the unload operation, by connecting the oil coolers 11A and 11B in series, the pressure loss of the whole oil coolers can be increased and the oil flow rate in the oil-feeding system can be decreased. Consequently, a flow rate of the oil to be fed to the compression chambers of the compressor body 1 can be prevented from becoming excessive to reduce a power consumption of the compressor body 1 during the unload operation.

In the aforementioned modified example, although the case that the oil-feeding system 6C includes two oil coolers 11A and 11B, and the connection switching circuit 23 for switching between the parallel connection and the series connection for the oil coolers 11A and 11B has been explained as an example, the present invention is not limited to this case, and modifications can be made without departing from the gist and the technical idea of the present invention. That means, the oil-feeding system may include three or more oil coolers, and a connection switching circuit for switching between a parallel connection and a series connection for at least two oil coolers among the three or more oil coolers.

In the first to third embodiments and their modified examples, although the case that the oil feed type air compressor includes the air-cooled type oil cooler and the cooling fan 13 for feeding cooling air to the oil cooler, and the temperature control section 32 of the controller variably controls the rotation speed of the cooling fun 13 for variably controlling the cooling power of the oil cooler has been explained as an example, the present invention is not limited to this case, and modifications can be made without departing from the gist and the technical idea of the present invention. That means, the oil feed type air compressor includes the water-cooled oil cooler and the cooling water-feeding system for feeding cooling water to the oil cooler, and the temperature control section 32 of the controller may variably control a feeding flow rate of the cooling water for variably controlling the cooling power of the oil cooler. Also in this case, the same effect as described above can be obtained.

In the first to third embodiments and their modified examples, although the case that the operation control section 31 of the controller switches from the unload operation to load operation if the pressure detected by the pressure sensor 10 falls to the lower limit value has been explained as an example, the present invention is not limited to this case, and modifications can be made without departing from the gist and the technical idea of the present invention. That means, the operation control section 31 of the controller measures a duration of the unload operation, and once the duration reaches a predetermined time, the operation control section 31 may switch from the unload operation to the load operation. Also in this case, the same effect as described above can be obtained.

In the first to third embodiments and their modified examples, although the case that the oil feed type air compressor includes both the suction throttle valve 3 and the air relief system 7 for switching between the load operation and the unload operation for the compressor body 1 has been explained as an example, the present invention is not limited to this case, and modifications can be made without departing from the gist and the technical idea of the present invention. That means, the oil feed type air compressor may include only one of the suction throttle valve 3 and the air relief system 7. Also in this case, the same effect as described above can be obtained.

Furthermore, in the first to third embodiments, although the case that the oil feed type air compressor includes the screw type compressor body 1 has been explained as an example, the present invention is not limited to this case, and modifications can be made without departing from the gist and the technical idea of the present invention. That means, the oil feed type air compressor may include e.g. a scroll type compressor body. Also in this case, the same effect as described above can be obtained.

DESCRIPTION OF REFERENCE CHARACTERS

1: Compressor body
2: Electric motor
4: Separator
5: Compressed air-feeding system
6, 6A, 6B, 6C: Oil-feeding system
10: Pressure sensor
11, 11A, 11B: Oil cooler
12: Temperature sensor
13: Cooling fan
18: Flow control valve
19A, 19B: Oil feed pathway
20: Check valve
21: Throttle valve
22: Inverter
23: Connection switching circuit
30, 30A, 30B, 30C: Controller
31: Operation control section
32: Temperature control section
33: Flow control section
34: Distribution ratio control section
35: Connection switching control section

The invention claimed is:

1. An oil feed air compressor comprising:

a compressor body compressing air while feeding an oil into a compression chamber;

a separator separating a compressed air discharged from the compressor body and an oil contained in the compressed air;

a compressed air-feeding system feeding the compressed air separated by the separator to a use destination of the compressed air;

an oil-feeding system feeding the oil separated by the separator to the compression chamber of the compressor body;

an oil cooler and a temperature sensor disposed in the oil-feeding system; and a controller enabling execution of a temperature control for variably controlling a cooling power of the oil cooler such that an oil temperature detected by the temperature sensor is a target value, wherein in the temperature control by the controller, during a load operation, the cooling power of the oil cooler is variably controlled such that the oil temperature detected by the temperature sensor is a first target value, and during an unload operation, the cooling power of the oil cooler is variably controlled such that the oil temperature detected by the temperature sensor is a second target value lower than the first target value.

2. The oil feed air compressor according to claim 1, comprising a flow control valve disposed in the oil-feeding system, wherein the controller enables execution of a flow control for variably controlling an opening degree of the flow control valve to control a flow rate of the oil to be fed to the compression chamber of the compressor body, and in the flow rate control by the controller, during the unload operation, an opening degree of the flow control valve is adjusted so as to be smaller than an opening degree of the flow control valve during the load operation.

3. The oil feed air compressor according to claim 2, comprising an electric motor driving the compressor body, an inverter variably controlling a rotation speed of the electric motor, and an pressure sensor disposed in the compressed airfeeding system, wherein in an operation control by the controller, during the load operation, the rotation speed of the electric motor is variably controlled via the inverter such that a pressure of the compressed air detected by the pressure sensor is a predetermined target value, during the unload operation, the rotation speed of the electric motor is controlled via the inverter so as to be a lower limit value within a variable control range, and in the flow rate control by the controller, during the load operation, an opening degree of the flow control valve is variably controlled depending on the rotation speed of the electric motor, and during the unload operation, an opening degree of the flow control valve is adjusted so as to be smaller than a minimum value of an opening degree during the load operation.

4. The oil feed air compressor according to claim 2, wherein the oil-feeding system includes plural-stage oil feed pathways for feeding oil to each of a plurality of compression chambers having different progresses of compression process, a check valve disposed on a final-stage oil feed pathway among the plural-stage oil feed pathways, and a throttle valve disposed on another-stage oil feed pathway other than the final-stage oil feed pathway among the plural-stage oil feed pathways, and the controller enables execution of a distribution ratio control for variably controlling an opening degree of the throttle valve depending on a total flow of the oil in the oil-feeding system such that a distribution ratio of each oil to be fed from the plural-stage oil feed pathways to the plurality of compression chambers is constant.

5. The oil feed air compressor according to claim 4, wherein each of the plural-stage oil feed pathways has an inlet opening toward the compression chamber, and is configured such that a sectional area of an inlet of a poststage-side oil feed pathway is smaller than a sectional area of an inlet of a prestage-side oil feed pathway.

6. The oil feed air compressor according to claim 1, wherein the oil-feeding system includes a plurality of the oil coolers, and includes a connection switching circuit for switching between a parallel connection and a series connection for the plurality of oil coolers, and the controller enables execution of a connection switching control for controlling the connection switching circuit to switch the plurality of oil coolers into the parallel connection during the load operation, and controlling the connection switching circuit to switch the plurality of oil coolers into the series connection during the unload operation.

* * * * *